US005567039A

United States Patent [19]

Sims

[11] Patent Number: 5,567,039

[45] Date of Patent: Oct. 22, 1996

[54] CAP FOR HOLDING FLASHLIGHTS

[76] Inventor: B. Kelly Sims, 19 Elkins Lake, Huntsville, Tex. 77340

[21] Appl. No.: 567,647

[22] Filed: Dec. 4, 1995

[51] Int. Cl.[6] ..... F21L 15/14

[52] U.S. Cl. ..... 362/106; 362/191; 362/234

[58] Field of Search ..... 362/105, 106, 362/190, 191, 234, 253

[56] References Cited

U.S. PATENT DOCUMENTS

| | | | |
|---|---|---|---|
| 291,033 | 1/1884 | Couch et al. . | |
| 3,577,561 | 5/1971 | Oshima | 2/3 |
| 4,406,040 | 9/1983 | Cannone | 24/3 J |
| 4,517,685 | 5/1985 | Lesley | 2/170 |
| 4,665,568 | 5/1987 | Stutes | 2/209.2 |
| 4,718,126 | 1/1988 | Slay | 2/175 |
| 4,797,793 | 1/1989 | Fields | 362/105 |
| 4,827,384 | 5/1989 | Schlemmer | 362/106 |
| 4,991,068 | 2/1991 | Mickey | 362/106 |
| 5,053,932 | 10/1991 | Case | 362/105 |
| 5,102,024 | 4/1992 | Boersma et al. | 224/181 |
| 5,323,492 | 6/1994 | DeMars | 2/209.13 |
| 5,386,592 | 2/1995 | Checkeroski | 2/209.13 |
| 5,412,545 | 5/1995 | Rising | 362/105 |

*Primary Examiner*—Stephen F. Husar
*Attorney, Agent, or Firm*—Mathias W. Samuel

[57] ABSTRACT

A baseball type cap for holding a pair of flashlights. The cap having a crown portion and a forwardly extending bill. The cap having flashlight attachment means secured to each side of the crown portion of the cap; whereby, the flashlight attachment means, alone or in combination with the forwardly extending bill of the cap, secure the flashlights to the cap.

12 Claims, 3 Drawing Sheets

CAP FOR HOLDING FLASHLIGHTS

BACKGROUND OF THE INVENTION

The present invention relates to the combination of a cap and flashlight holding construction. More particularly, the invention relates to the combination of a baseball type cap and a pair of flashlights secured to the sides of the cap by flashlight attachment means.

There are many tasks which are performed at night or in a dark environment which require the use of a flashlight. Examples are numerous, but those that often arise are the tasks associated with hunting or fishing at night, exercising at night, working on an automobile engine or the like, and performing household or other repairs in a dark space. It has been a problem in the past that individuals performing these or similar tasks have had difficulty in controlling a flashlight while attempting to perform the task. It has also been a problem in the past that many of the aforementioned tasks, especially those involving repairs, require accurate placement of the beam of light. In the situation where the individual is attempting to hold the beam of light while conducting repairs such accuracy has been difficult to maintain.

It has long been the practice to mount a light source to various types of headgear. As an example, it is well known in the prior art for miners to rigidly mount carbide lamps on their hard hats. More recently, battery powered lamps have replaced the carbide lamps, but it has continued to be the practice to rigidly attach the various types of lamps to the hard hat. These various types of coal miner lamps enable the coal miner to freely use both of his hands while working. This type of mounting is an effective means of securing a light source to a hard hat. As one would expect, however, the hard hat, the mounting structure, and the lamp itself are heavy and cumbersome to use as well as being expensive. An additional problem associated with a heavy light mounted on a hard hat is that typically the hard hat/light combination is ill fitting and does not allow for minor adjustments in the direction of the beam of light to be made.

The prior art also contains numerous examples of light sources being attached to headbands of various sorts. U.S. Pat. No. 4,462,064 issued to Schweitzer discloses an elastic headband with an adhesively bonded tubular clip orientated laterally and transversely on the headband by a wedge whereby friction retains the flashlight in the clip. However, Schweitzer's invention does not embody means for retaining more than one flashlight thereon.

U.S. Pat. No. 4,718,126 issued to Slay discloses an apparatus for holding a flashlight comprising a longitudinally aligned first and a second strap, and a section of elastic material affixed to the second strap and arranged so as to define an expandable flashlight receiving hole suitable for receiving a flashlight.

Although a headband provides a suitable means of supporting a light source, a headband does not readily allow for minor adjustments in the fit and position of the headband to be made as is possible with a typical baseball cap. A headband also lacks the forward extending bill of a baseball cap, as well as the front strap present on many baseball caps, both of which provide support and serve to secure the light source, and, in particular, the light emitting forward end of the light source when the wearer is in motion. Because of these various limitations, the typical headband is only capable of supporting a single light source and the size of the light source, and thus the intensity and brightness of the light emitted, is limited by the minimal supporting apparatus provided by a headband.

In order to overcome the various problems associated with the prior art it is desirable to provide a lightweight and inexpensive means of attaching a light to a baseball style cap. A cap having a pair of flashlights attached to the sides provides tremendous utility and versatility for an individual attempting to work in an area with a limited supply of light such as under a sink or in a similarly confined area. As another example, night fisherman commonly wear a baseball or similar cap formed entirely of cloth or with a cloth bill or brim and a plastic mesh crown. A baseball cap having the attachment means claimed herein is capable of supporting a larger diameter and thus brighter flashlight than the various support structures of the prior art. The use of a baseball cap as a support mechanism as disclosed and claimed in the claimed invention also allows for a much greater level of comfort for the wearer than the various support mechanisms of the prior art.

SUMMARY OF THE INVENTION

It is therefore a primary object of the present invention to provide a cap having flashlight attachment means for attaching a pair of flashlights to the cap. Such a cap can be readily manufactured at a low cost.

It is a further object of the invention to provide a cap having a pair of flashlights attached to either side which securely fits the head of the wearer while still allowing the wearer to make minor adjustments to the direction of the beam of light by adjusting the cap on his/her head.

Additionally, it is an object of the invention to provide a cap having a pair of flashlights attached thereto, the cap being adjustable to provide maximum comfort for the wearer while allowing for a secure fit of the cap to the head of the wearer.

It is a further object of the invention to provide a cap having a forwardly extending bill which supports the light emitting ends of the flashlights attached to either side of the cap by flashlight attachment means.

It is a further object of the invention to provide a cap having a strap extending between the outermost portions of the forwardly extending bill, the strap securing the light emitting ends of the flashlights to the bill of the cap.

In order to achieve the foregoing objects there is disclosed a preferred embodiment of the invention comprising: a baseball type cap having a crown and a forwardly extending bill; the crown having side portions; flashlight attachment means secured to each of said side portions; and a flashlight attached to said flashlight attachment means.

In one embodiment the flashlight attachment means comprises a velcro acceptor pad secured to each of said side portions of said cap and velcro wrapped around a center portion of said flashlight. The velcro being removably attached to said velcro acceptor pad.

In an alternative embodiment the flashlight attachment means comprises an elastic band having ends; one of the ends of the elastic band being secured to an upper portion of one of the side portions; the other of said ends of said elastic band being secured to a lower portion of said one side portion, whereby a flashlight receiving opening is formed between said one side portion of said cap and said elastic band.

In an alternative embodiment the flashlight attachment means comprises an elastic band having first and second end portions and an outer side and an inner side; the outer side of said first end portion being attached to one of said side portions of said cap; the inner side of said first end portion having a velcro acceptor pad secured thereto; the inner side of said second end portion having velcro attached thereto, said velcro being sized to correspond to said velcro acceptor pad, whereby said velcro removably attaches to said velcro acceptor pad so as to form a flashlight receiving opening.

In another embodiment of the invention, the flashlight attachment means comprises a strip of rubber material having ends; the strip having openings tending towards the ends; the openings being generally horizontal relative to each other and sized to securely receive a flashlight therein.

In another embodiment of the invention, each flashlight has a second end opposite its light emitting end and reflective material is attached to the second end, such that the reflective material allows a wearer of the cap/flashlight to be visible from the rear when at night.

These and other features, aspects, objects and advantages of the present invention will become better understood with regards to the following descriptions, appended claims and accompanying drawings.

DETAILED DESCRIPTION OF THE PREFERRED EMBODIMENT

Figure 1:
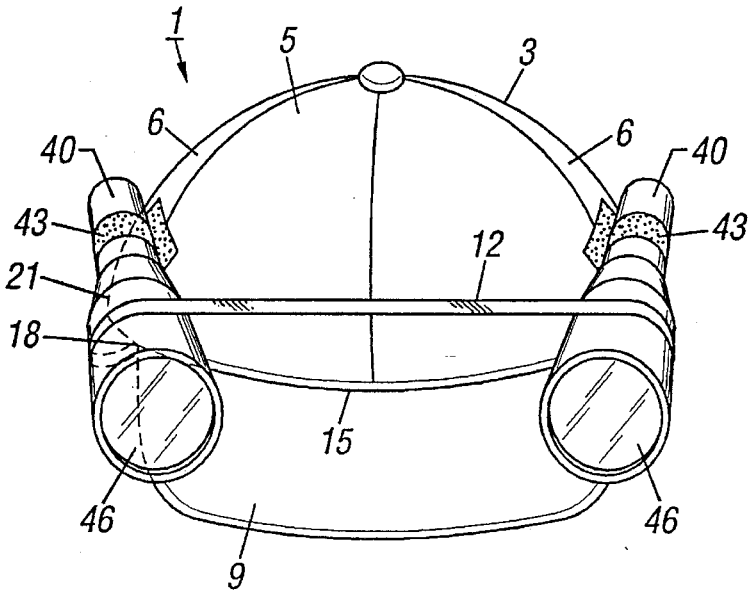
FIG. 1 is a front view of a cap and flashlight combination in accordance with the present invention.
Figure 2:
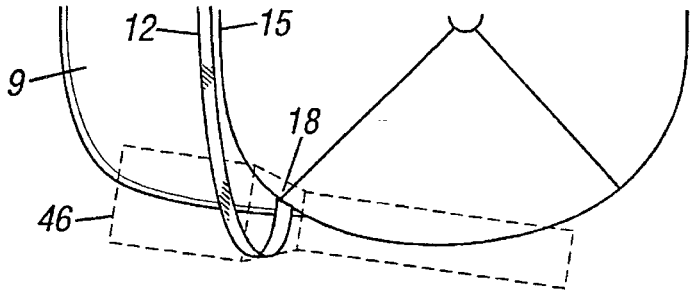
FIG. 2 is an exploded view of the light emitting end of the flashlight and the forwardly extending bill of FIG. 1 as viewed from the side of the cap.
Figure 3:
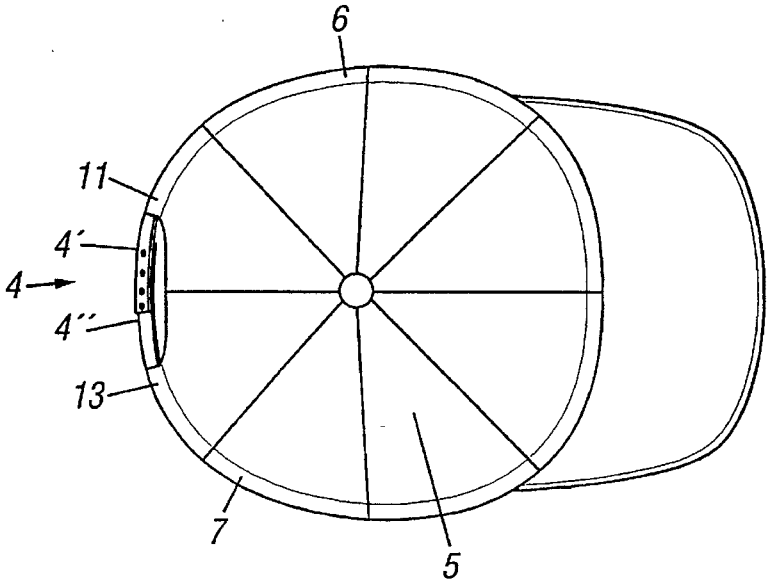
FIG. 3 is a bottom view of the cap.
Figure 4:
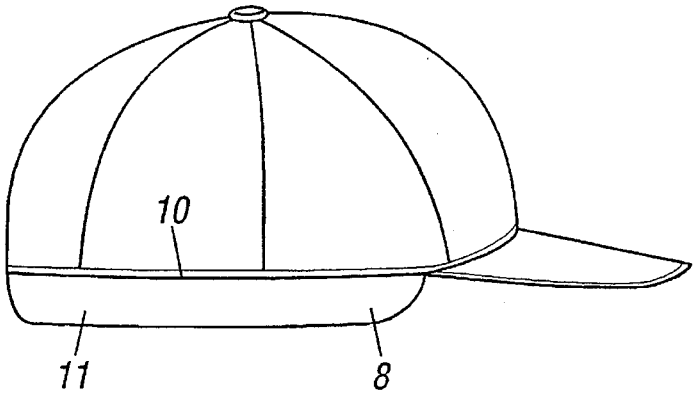
FIG. 4 is a cross sectional view of the cap of FIG. 1.

Referring generally to FIGS. 1, 2, 3, 4, and 5 there is shown generally a combination of a cap and flashlights 1 comprising a baseball style cap 3 having a crown 5 containing side portions 6, a forwardly extending bill 9, a liner 7 circumscribing at least a segment of the crown 5 and cap adjustment means 4 comprising two adjustably connectable sections 4' and 4" which may be fastened together to fit the combination 1 to the head of a user. As depicted in FIGS. 3 and 4, the liner 7 comprises a strip of material having an upper edge 8, a lower edge 10, a first end 11 and a second end 13. The lower edge 10 of the liner 7 is secured to the crown 5 by sewing the edges of the crown and liner together. The upper edge 8 is generally folded upward during normal use so that it lies against the inner surface of the crown and is generally between the head of the wearer and the crown 5 when the cap is in use.

Figure 5:
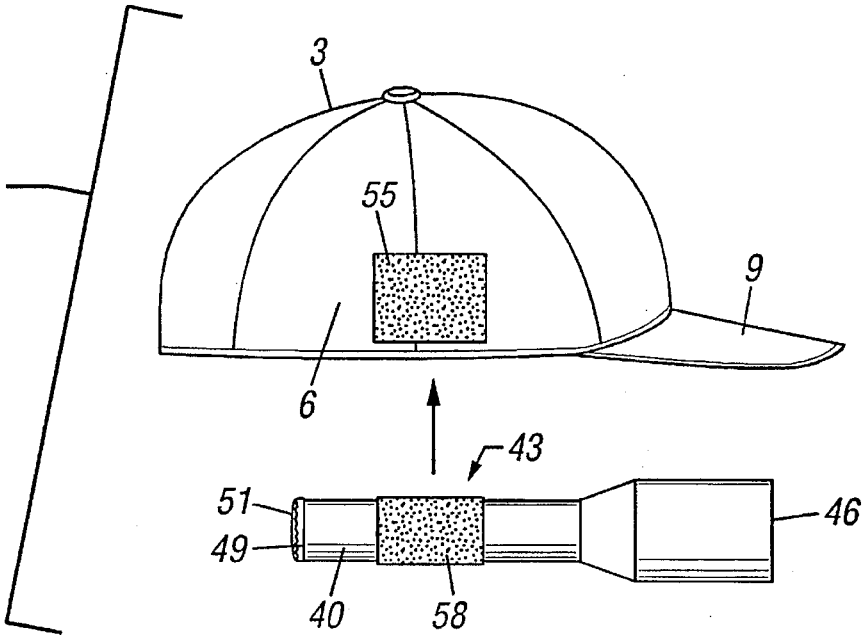
FIG. 5 is a front perspective view of the cap and the flashlight attachment means of FIG. 1.

As depicted in FIGS. 1 and 5, a flashlight 40 is removably attached by flashlight attachment means 43 to the side portion 6 of the cap 3. The flashlight 40 is positioned so that the light emitting end of the flashlight 46 extends toward the forwardly extending bill 9 of the cap 3. In one embodiment, a portion of the light emitting end 46 of the flashlight 40 is supported by the forwardly extending bill 9. The flashlight 40 may consist of any type of light of suitable weight, length and diameter for attachment to a standard baseball type cap. The preferred dimensions of the flashlight 40 are approximately 6" in length and 1" in diameter, although the length and diameter of the flashlight 40 may be adjusted in accordance with the specific use for which the invention is being utilized. However, it is a primary feature and benefit of the invention that the use of a baseball cap 3 having a forwardly extending bill 9 in conjunction with the attachment means claimed herein as the support and attachment structure for the light source allows the use of a flashlight 40 of greater width and diameter than was possible with any of the various light supporting devices disclosed in the prior art, and thus provides a brighter more intense light source for the user.

The flashlight attachment means 43 securely attaches the flashlight 40 to the side portion 6 of the cap 3. The various embodiments of the flashlight attachment means will now be discussed in detail.

Figure 6:
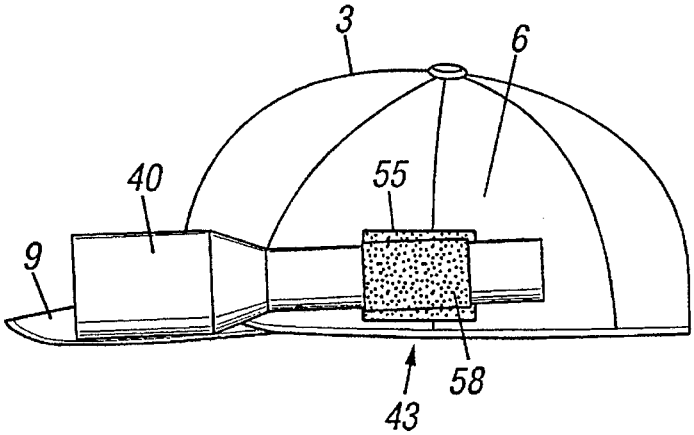
FIG. 6 is a side view of a cap depicting one embodiment of the flashlight attachment means.

In one embodiment depicted in FIGS. 5 and 6, the flashlight attachment means 43 comprises a velcro acceptor pad 55 secured to the side portion 6 of the cap 3. The velcro acceptor pad 55 is of a type well known in the prior art. The velcro acceptor pad 55 is secured to the side portion 6 by any of a number of means including gluing, heat bonding, or sewing all of these methods being well known in the prior art. The positioning of the pad is somewhat dependent on the dimensions of the flashlight 40 being used; however, generally, the pad 55 is secured to a lower portion of the side portion 6 such that the light emitting end 46 of the flashlight extends slightly beyond the front face of the crown 5. A corresponding piece of velcro 58 is wrapped around a central portion of the body of the flashlight 40. The velcro 58 binds to the velcro acceptor pad 55 in a manner well known in the art.

The use of the attachment means depicted in FIGS. 5 and 6 provides numerous advantages over the prior art. The velcro acceptor pad 55 may be positioned in a range of locations on the side portion depending on the dimensions of the flashlight being used and the foreseeable use of the cap/flashlight combination. Additionally, the positioning of the flashlight may be adjusted forwardly or rearwardly by adjusting the placement of the velcro 58 on the velcro acceptor pad 55. The angle of the flashlight 40 relative to the horizontal may also be adjusted through positioning of the velcro 58 on the velcro acceptor pad 55.

Figure 7:
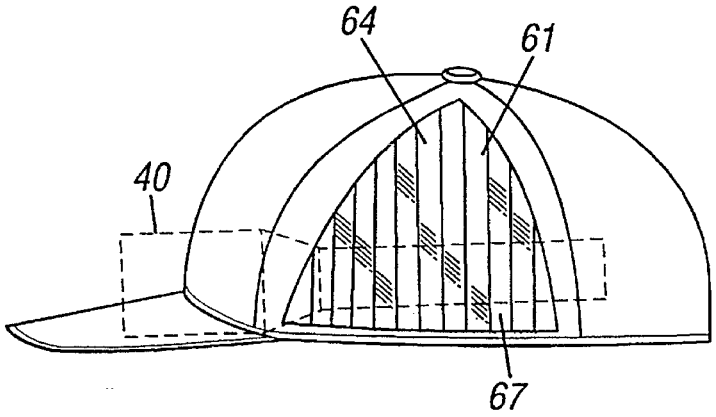
FIG. 7 is a side view of a cap depicting an alternative embodiment of the flashlight attachment means.

In another embodiment depicted in FIG. 7, the flashlight attachment means comprises an elastic or similarly flexible band of material 61 having upper and lower ends 64 and 67. The upper end 64 is attached to an upper portion of the side portion 6. The lower portion 67 is attached to a lower portion of the side portion 6. The ends of the elastic band 61 are attached so that an opening somewhat smaller than the diameter of the flashlight 40 is formed between the elastic band 61 and the side portion 6 of the cap. Because the material is elastic or similar material, the opening will expand when the flashlight 40 is inserted therein and the flashlight will be securely held in place. Although the elastic band may be of any shape, i.e., rectangular, rounded on one or both ends, or a similar shape, generally the elastic band 61 utilized has a parabolic shaped upper end 64 and a square lower end 67. The elastic band 61 may be attached to the side portion 6 by gluing, heat bonding, or sewing, all of these methods being well known in the prior art.

Figure 8:
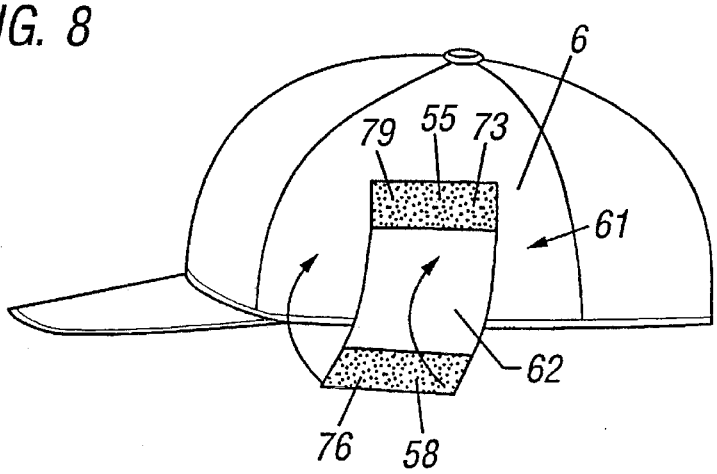
FIG. 8 is a side view of a cap depicting an alternative embodiment of the flashlight attachment means.

Another embodiment of the flashlight attachment means is depicted in FIG. 8. An elastic band 62 having an attached end 73 and a free end 76 is mounted to the side portion 6. The attached end 73 is secured to an upper portion of the side portion 6 by any of the variety of means previously discussed. The attached end has an inner portion 79 which has a velcro acceptor pad 55 secured thereto. The free end 76 of the elastic band 70 has velcro 58 which can be attached to the velcro acceptor pad 55 in a manner well known in the art. When the free end 76 is attached to the attached end 73 the elastic band 62 forms a loop around the flashlight 40 and secures the flashlight 40 to the side portion 6 of the hat 3. The elastic band 62 of this embodiment is generally rectangular in shape, however, the exact shape of the band 62 is not critical.

Figure 9:
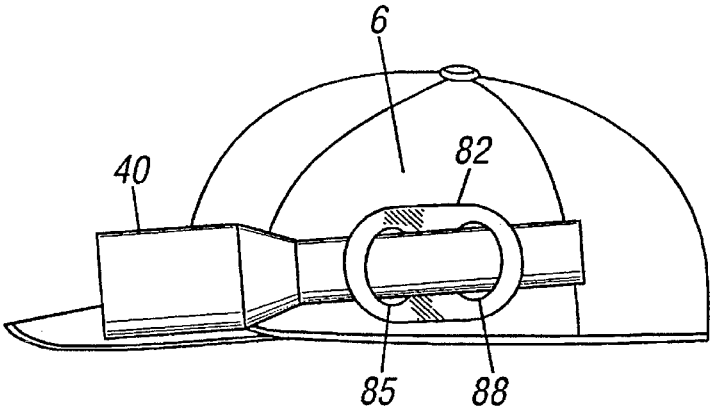
FIG. 9 is a side view of a cap depicting an alternative embodiment of the flashlight attachment means.

A further embodiment of the flashlight attachment means 43 is depicted in FIG. 9. A strip 82 of rubber material is attached to side portion 6. The strip 82 is attached by gluing, heatbonding or sewing. The strip 82 is positioned so that it extends horizontally along side portion 6. The strip 82 has a forward opening 85 and a rearward opening 88. The openings being sized to receive a flashlight 40. The strip 82 consists of recyclable material and thus has the added advantage of being relatively inexpensive while being environmentally sound. The placement of the strip 82 on the side portion 6 may be adjusted in the manufacturing process to allow for optimum placement of the flashlight 40 in accordance with the desired use of the cap/flashlight combination.

As depicted in FIGS. 1 and 2, the forwardly extending bill 9 supports the light emitting end 46 of the flashlight. In the preferred embodiment, the crown 5 and the forwardly extending bill 9 of the cap form a junction 15 therebetween. The light emitting end 46 rests on the forwardly extending bill 9 at the outer portions 18 of the junction 15. Positioning of the light emitting end 46 on the forwardly extending bill 9 is adjustable through adjustment of the placement of the flashlight attachment means 43 on the side portions 6 in the manufacturing process. Because the combination is intended to be used for a wide variety of activities in which the wearer will be moving, the support provided by the forwardly extending bill 9 is critical to prevent excessive movement of the flashlight 40. A strap 12 may also be secured to the outer portions 18 of the junction 15 and extend therebetween. The strap 12 passes over the top of the light emitting end 46 of the flashlight 40 and secures the light emitting end 46. The strap is generally constructed of a flexible material such as elastic or the like which allows the strap 12 to secure the flashlight 40 without exerting undue pressure.

As shown in FIG. 5, the flashlight 40 may have a second end 49 opposite said light emitting end 46. The second end having reflective means 51 attached thereto. The reflective means may consist of reflective material or a light all being well known in the prior art. The reflective means allows the wearer of the cap/flashlight to be visible from the rear when using the cap/flashlight at night.

The present invention, therefore, is well adapted to carry out the objects and attain the ends and advantages mentioned as well as others inherent therein. While a presently preferred embodiment of the invention has been given for the purpose of disclosure, numerous changes in the details of construction, and steps of the process will be readily apparent to those skilled in the art, and which are encompassed within the spirit of the invention and the scope of the appended claims.

What is claimed is:

1. A cap for holding at least one flashlight on the head of a user, comprising:

a baseball type cap having a crown and a forwardly extending bill;

said crown having side portions;

flashlight attachment means secured to each of said side portions; and a flashlight attached to said flashlight attachment means.

2. The cap of claim 1 wherein, said flashlight attachment means comprises:

a velcro acceptor pad secured to each of said side portions of said cap; and velcro wrapped around a center portion of said flashlight;

said velcro removably attaching to said velcro acceptor pad.

3. The cap of claim 1 wherein, said flashlight attachment means comprises:

an elastic band having ends;

one of said ends of said elastic band being secured to an upper portion of one of said side portions;

the other of said ends of said elastic band being secured to a lower portion of said one side portion, whereby a flashlight receiving opening is formed between said one side portion of said cap and said elastic band.

4. The cap of claim 1 wherein, said flashlight attachment means comprises:

an elastic band having first and second end portions and an outer side and an inner side;

the outer side of said first end portion being attached to one of said side portions of said cap;

the inner side of said first end portion having a velcro acceptor pad secured thereto;

the inner side of said second end portion having velcro attached thereto, said velcro being sized to correspond to said velcro acceptor pad, whereby said velcro removably attaches to said velcro acceptor pad so as to form a flashlight receiving opening.

5. The cap of claim 2, 3 or 4 wherein, said crown and said forwardly extending bill form a junction therebetween;

said junction having ends;

said flashlight has a light emitting end; and said light emitting end contacts said forwardly extending bill at said junction, such that said forwardly extending bill limits the downward movement of said light emitting end.

6. The cap of claim 5 wherein, a strap extends between said end portions of said junction;

said strap holds said light emitting end of said flashlight between said forwardly extending bill and said crown portion at said junction.

7. The cap of claim 1 wherein, each of said side portions of said cap has a forward and rearward opening; and said flashlight attachment means comprises:

an eyelet secured in each of said openings;

said eyelets being sized to securely receive a flashlight therein.

8. The cap of claim 1 wherein, said flashlight attachment means comprises a strip of rubber material having ends;

said strip having openings tending toward each of said ends;

said openings being generally horizontal relative to each other;

said openings being sized to securely receive a flashlight therein.

9. In combination with a baseball type cap and a pair of flashlights, the baseball type cap having a forwardly extending bill, a crown having side portions, a junction formed between said crown and said forwardly extending bill, said junction having ends, a liner circumscribing at least a portion of an edge of the crown, and an adjustable strap operatively associated with the crown for adjusting the cap to various different head sizes:

flashlight attachment means secured to each of said side portions of said baseball type cap;

one of said flashlights being attached to one of said flashlight attachment means and the other of said flashlights being attached to the other of said flashlight attachment means.

10. The combination of claim 9 wherein, each of said flashlights have a light emitting end;

said light emitting end contacts said forwardly extending bill at said junction, such that said forwardly extending bill limits the downward movement of said light emitting end.

11. The combination of claim 10 wherein, a strap extends between said end portions of said junction; and said strap holds said light emitting end of said flashlight between said forwardly extending bill and said crown portion at said junction.

12. The combination of claim 10 wherein, said flashlight has a second end opposite said light emitting end;

said second end having reflective means attached thereto, whereby said reflective means allows a wearer of said combination to be visible from the rear when said combination is worn at night.

* * * * *